US011005162B2

(12) United States Patent
Hu et al.

(10) Patent No.: US 11,005,162 B2
(45) Date of Patent: May 11, 2021

(54) ANTENNA STRUCTURE OF WIRELESS COMMUNICATION DEVICE

(71) Applicant: Chiun Mai Communication Systems, Inc., New Taipei (TW)

(72) Inventors: Cheng-Nan Hu, New Taipei (TW); Kwo-Jyr Wong, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 55 days.

(21) Appl. No.: 16/545,213

(22) Filed: Aug. 20, 2019

(65) Prior Publication Data

US 2020/0067178 A1 Feb. 27, 2020

(30) Foreign Application Priority Data

Aug. 21, 2018 (CN) ..... 201810955002.4

(51) Int. Cl.

| | |
|---|---|
| ***H01Q 1/24*** | (2006.01) |
| ***H01Q 1/36*** | (2006.01) |
| ***H01Q 9/04*** | (2006.01) |
| ***H01Q 5/378*** | (2015.01) |
| ***H01Q 5/328*** | (2015.01) |

(52) U.S. Cl.

CPC ..... *H01Q 1/243* (2013.01); *H01Q 1/36* (2013.01); *H01Q 5/328* (2015.01); *H01Q 5/378* (2015.01); *H01Q 9/0414* (2013.01)

(58) Field of Classification Search

None

See application file for complete search history.

(56) References Cited

U.S. PATENT DOCUMENTS

| | | | | |
|---|---|---|---|---|
| 9,293,815 | B1 * | 3/2016 | Horner | H01Q 1/36 |
| 2005/0169388 | A1 | 8/2005 | Toland et al. | |
| 2014/0361946 | A1 | 12/2014 | Ganchrow et al. | |
| 2016/0276751 | A1 | 9/2016 | Ueda | |
| 2019/0386384 | A1 * | 12/2019 | Villa | H01Q 21/28 |
| 2020/0295437 | A1 * | 9/2020 | Ueda | H01Q 9/30 |

FOREIGN PATENT DOCUMENTS

| | | |
|---|---|---|
| CN | 1901282 | 1/2007 |
| CN | 101217217 A | 7/2008 |
| CN | 105794043 A | 7/2016 |
| CN | 105934851 A | 9/2016 |
| CN | 106876879 A | 6/2017 |
| CN | 107221759 | 9/2017 |

* cited by examiner

*Primary Examiner* — Jany Richardson

(74) *Attorney, Agent, or Firm* — ScienBiziP, P.C.

(57) ABSTRACT

An antenna structure includes a first array antenna having a number of first antenna units. The antenna units are arranged along a first direction and a second direction. The first antenna units are monopole antennas. The monopole antennas include a radiating body having a strip portion and a bulb portion. The radiating body generates radiation along the first direction or the second direction. The strip portion is electrically coupled to a signal source. The bulb portion is electrically coupled to the strip portion. An end of the bulb portion away from the strip portion is semi-circular in shape.

20 Claims, 19 Drawing Sheets

ANTENNA STRUCTURE OF WIRELESS COMMUNICATION DEVICE

FIELD

The subject matter herein generally relates to antenna structures, and more particularly to an antenna structure of a wireless communication device.

BACKGROUND

Millimeter wave (mmWave) antennas are gradually being applied in wireless communication devices such as mobile phones and Customer Premise Equipment (CPE). However, when the mmWave antenna is applied in the communication device, radiation of the mmWave antenna is susceptible to interference from a metal frame of the wireless communication device such that the radiation field is shielded.

BRIEF DESCRIPTION OF THE DRAWINGS

Implementations of the present disclosure will now be described, by way of embodiments only, with reference to the attached figures.

DETAILED DESCRIPTION

Figure 1:
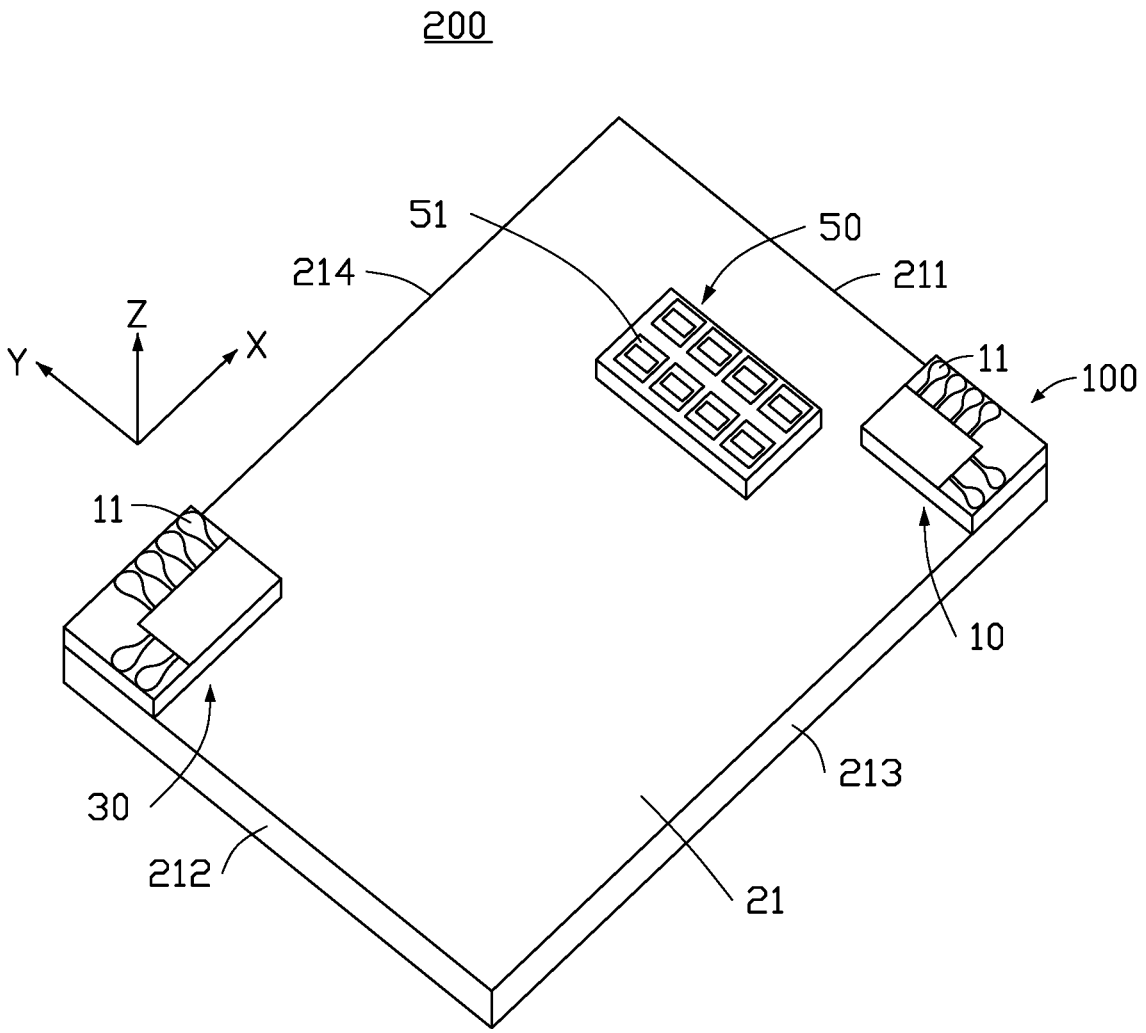
FIG. 1 is a schematic diagram of an antenna structure applied in a wireless communication device in accordance with an embodiment of the present disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as coupled, whether directly or indirectly through intervening components, and is not necessarily limited to physical connections. The connection can be such that the objects are permanently coupled or releasably coupled. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of an antenna structure 100 that can be applied in a wireless communication device 200. The wireless communication device 200 may be a mobile phone, customer premise equipment (CPE), or other electronic communication device for transmitting and receiving wireless signals.

The wireless communication device 200 further includes a motherboard 21 and a metal frame (not shown). The motherboard 21 may be a printed circuit board (PCB). The motherboard 21 can be made of a dielectric material such as epoxy glass fiber (FR4). The motherboard 21 is received in a space surrounded by the metal frame and spaced from the metal frame.

The motherboard 21 includes a first end portion 211, a second end portion 212, a first side portion 213, and a second side portion 214. The first end portion 211 is opposite and parallel to the second end portion 212. The first side portion 213 is opposite and parallel to the second side portion 214, and the first side portion 213 and the second side portion 214 are both coupled between the first end portion 211 and the second end portion 212. The first end portion 211 and the second end portion 212 may respectively correspond to a top end and a bottom end of the wireless communication device 200. A length of each of the first side portion 213 and the second side portion 214 is greater than a length of each of the first end portion 211 and the second end portion 212.

The first side portion 213 and the second side portion 214 are both parallel to a first direction (X-axis direction), and the first end portion 211 and the second end portion 212 are both parallel to a second direction (Y-axis direction). The first direction and the second direction are orthogonal to each other. The motherboard 21 is parallel to the XY plane and perpendicular to a Z-axis.

The antenna structure 100 includes at least one first array antenna and a second array antenna 50. In one embodiment, the antenna structure 100 includes two first array antennas, such as a first array antenna 10 and a first array antenna 30. The first array antenna 10 is located at a corner of the motherboard 21, such as a corner between the first end portion 211 and the first side portion 213 for generating radiation along the first direction and the second direction. The first array antenna 30 is located at an opposite side of the motherboard 21, such as a corner between the second end portion 212 and the second side portion 214 for generating radiation along the first direction and the second direction.

The first array antenna 10 and the first array antenna 30 are located at opposite sides of the motherboard 21. Thus, when the wireless communication device 200 is held, at least one of the first array antenna 10 and the first array antenna 30 is not shielded, that is, the radiation along the first direction and the second direction is not affected by a user's hand.

In one embodiment, the first array antenna 10 includes N1 plus M1 first antenna units 11. N1 and M1 are positive integers greater than or equal to 1. The N1 first antenna units 11 are arranged on the first side portion 213 and are arranged at intervals along the first direction. The M1 first antenna units 11 are arranged at the first end portion 211 and are arranged at intervals along the second direction. In one embodiment, N1 is equal to 2, and M1 is equal to 4. That is, the first array antenna 10 includes 2+4 first antenna units 11. In other embodiments, the number of the first antenna units 11 of the first array antenna 10 along the first direction and the second direction can be adjusted according to specific requirements.

In one embodiment, the first antenna units 11 are monopole antennas and are millimeter wave (mmWave) antennas. Each of the first antenna units 11 may have a structure as shown in FIG. 2A, FIG. 2B, or FIG. 2C.

Figure 2A:
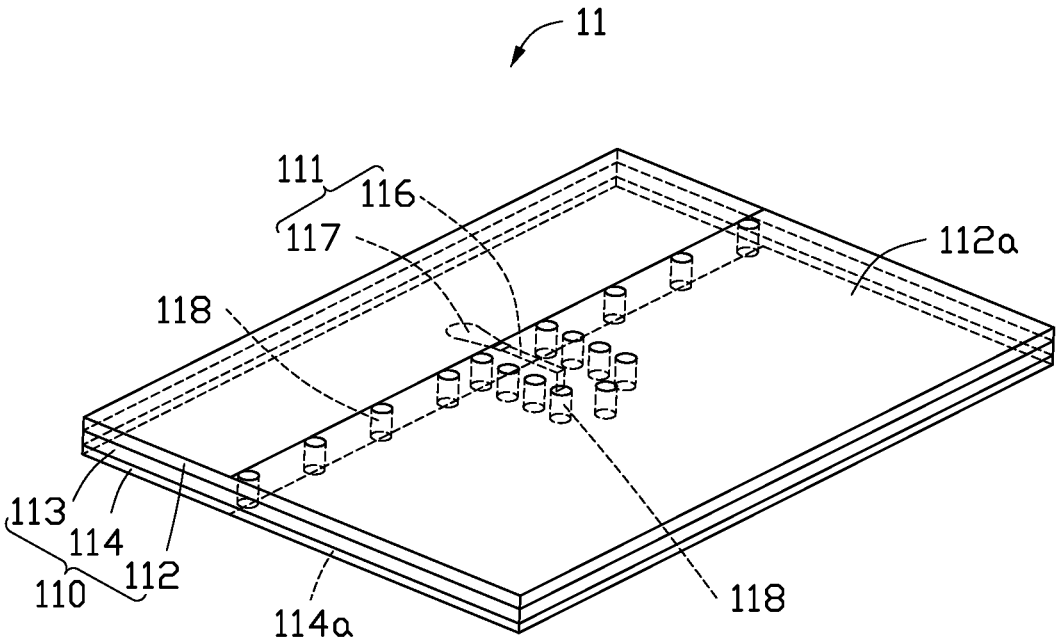
FIGS. 2A-2C are schematic views showing a first antenna unit of the first array antenna in FIG. 1.
Figure 2B:
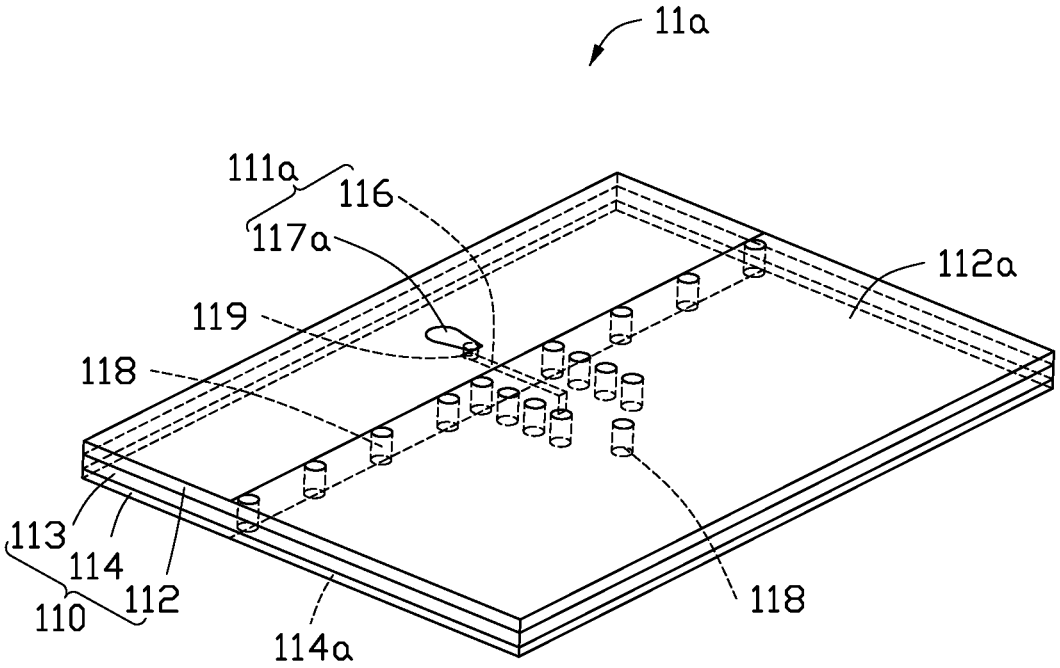
Figure 2C:
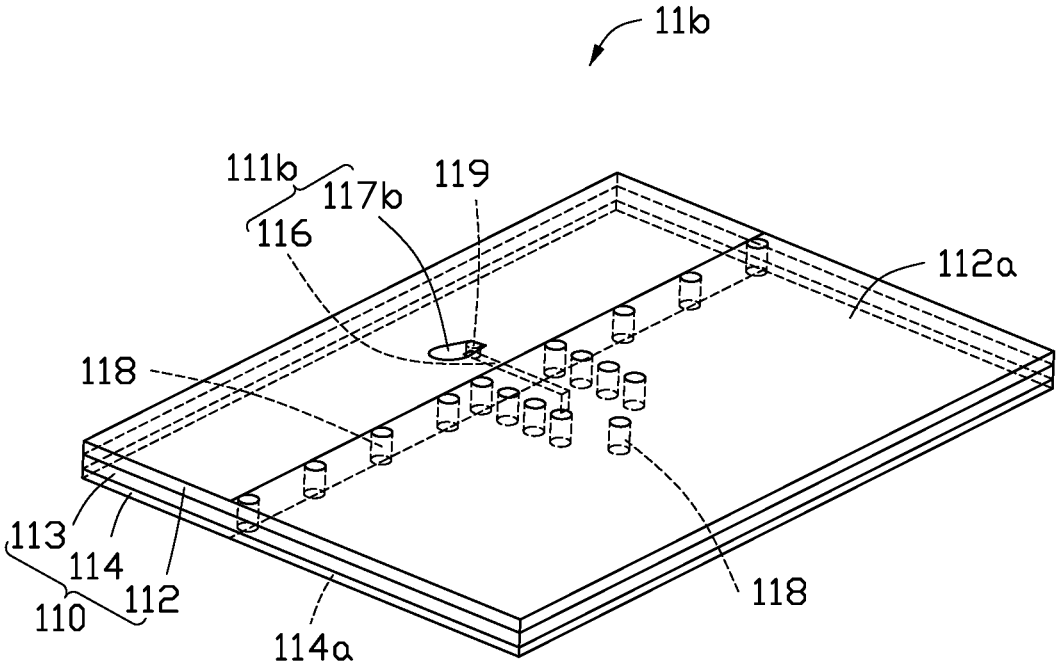

As shown in FIG. 2A, in one embodiment, each of the first antenna units 11 includes a substrate 110 and a radiating body 111.

The substrate 110 is a multilayer circuit board. In one embodiment, the substrate 110 is a three-layer circuit board and includes a first layer 112, a middle layer 113, and a second layer 114. The first layer 112, the middle layer 113, and the second layer 114 are stacked in sequence, such that the middle layer 113 is between the first layer 112 and the second layer 114. The first layer 112 includes a first ground plane 112*a*. The second layer 114 includes a second ground plane 114*a*.

The radiating body 111 includes a strip portion 116 and a bulb portion 117. The strip portion 116 is substantially straight and is arranged on the middle layer 113. An end of the strip portion 116 is electrically coupled to a signal source (not shown) for supplying an electric current to the radiating body 111. The bulb portion 117 has a substantially teardrop shape and is arranged on the middle layer 113. An end of the bulb portion 117 is coupled to the strip portion 116, and the bulb portion 117 extends along a direction of extension of the strip portion 116 toward an edge of the wireless communication device 200. A width of the end of the bulb portion 117 coupled to the strip portion 116 is equal to a width of the strip portion 116, and gradually widens along a direction away from the strip portion 116. A width of an end of the bulb portion 117 away from the strip portion 116 is greater than the width of the strip portion 116. An end of the bulb portion 117 away from the strip portion 116 is semicircular. The bulb portion 117 is more adjacent to the edge of the wireless communication device 200 than the strip portion 116.

A plurality of first vias 118 is arranged on the substrate 110. The first vias 118 are configured to communicate with the first ground plane 112*a* and the second ground plane 114*a*. In one embodiment, the first vias 118 partially surround the strip portion 116 to provide electromagnetic shielding effect, so that the radiation of the radiating body 111 is mainly focused on two sides of the bulb portion. In one embodiment, if the strip portion 116 is arranged along the X-axis direction, the radiation direction of the radiating body 111 is along the Y-axis direction. If the strip portion 116 is arranged along the Y-axis direction, the radiation direction of the radiating body 111 is along the X-axis direction. That is, the radiation direction of the radiating body 111 is perpendicular to the strip portion 116.

The strip portions 116 of the N1 first antenna units 11 of the first array antenna 10 are all aligned along the second direction, and thus the radiation direction of the N1 first antenna units 11 is along the first direction. The strip portions 116 of the M1 first antenna units 11 of the first array antenna 10 are all aligned along the first direction, and thus the radiation direction of the M1 first antenna units 11 is along the second direction.

FIG. 2B shows a schematic structural diagram of a first antenna unit 11*a* according to a second embodiment. The structure of the first antenna unit 11*a* is similar to that of the first antenna unit 11, including the substrate 110, a radiating body 111*a*, and the plurality of first vias 118. The substrate 110 is a three-layer circuit board including a first layer 112, a middle layer 113, and a second layer 114. The first layer 112, the middle layer 113, and the second layer 114 are stacked in sequence. The first layer 112 includes a first ground plane 112*a*. The second layer 114 includes a second ground plane 114*a*. The radiating body 111*a* includes a strip portion 116 and a bulb portion 117*a*. The strip portion 116 is substantially straight and is arranged on the middle layer 113. An end of the strip portion 116 is coupled to a signal source (not shown) for supplying an electric current to the radiating body 111*a*.

In one embodiment, a difference between the first antenna unit 11*a* and the first antenna unit 11 is that the bulb portion 117*a* is not arranged on the middle layer 113, but is arranged on the first layer 112 and electrically coupled to the strip portion 116 through a via 119.

FIG. 2C shows a schematic structural diagram of a first antenna unit 11*b* according to a third embodiment. A structure of the first antenna unit 11*b* is similar to that of the first antenna unit 11*a*, including a substrate 110, a radiating body 111*b*, and a plurality of first vias 118. The substrate 110 is a three-layer circuit board including a first layer 112, a middle layer 113, and a second layer 114. The first layer 112, the middle layer 113, and the second layer 114 are stacked in sequence. The first layer 112 includes a first ground plane 112*a*. The second layer 114 includes a second ground plane 114*a*. The radiating body 111*b* includes a strip portion 116 and a bulb portion 117*b*. The strip portion 116 is substantially straight and is arranged on the middle layer 113. An end of the strip portion 116 is coupled to a signal source (not shown) for supplying an electric current to the radiating body 111*b*. The bulb portion 117*b* is arranged on the first layer 112 and is electrically coupled to the strip portion 116 through a via 119.

In one embodiment, a difference between the first antenna unit 11*b* and the first antenna unit 11*a* is that the bulb portion 117*b* does not extend along the extending direction of the strip portion 116, but extends 90 degrees to the extending direction of the strip portion 116. Thus, the bulb portion 117*b* of FIG. 2C extends in a direction perpendicular to the strip portion 116 on one side of the strip portion 116 along the XY plane. In other embodiments, the bulb portion 117*b* may extend perpendicular to another side of the strip portion 116 along the XY plane or extend erect along the Z direction in the first layer 112 where the first ground plane 112*a* is not arranged.

Referring again to FIG. 1, in one embodiment, a shape and a structure of the first array antenna 30 are similar to a shape and a structure of the first array antenna 10, including M1+N1 first antenna units such as 11, 11*a*, or 11*b*. The M1 first antenna units 11, 11*a*, or 11*b* of the first array antenna 30 are arranged on the second side portion 214 and are arranged at intervals along the first direction. The N1 first antenna units 11, 11*a*, or 11*b* of the first array antenna 30 are arranged at the second end portion 212 and are arranged at intervals along the second direction.

The strip portions 116 of the M1 first antenna units 11/11*a*/11*b* of the first array antenna 30 are all arranged along the second direction, and thus the radiation direction of the M1 first antenna units 11/11*a*/11*b* of the first array antenna 30 is along the first direction. The strip portions 116 of the N1 first antenna units 11/11*a*/11*b* of the first array antenna 30 are all along the first direction, and thus the radiation direction of the N1 first antenna units 11/11*a*/11*b* of the first array antenna 30 is along the second direction.

In this embodiment, the number of the first antenna units 11/11*a*/11*b* of the first array antenna 10 arranged along the first direction is equal to the number of the first antenna units 11/11*a*/11*b* of the first array antenna 30 arranged along the second direction. The number of the first antenna units 11/11*a*/11*b* of the first array antenna 10 arranged along the second direction is equal to the number of the first antenna units 11/11*a*/11*b* of the first array antenna 30 arranged along the first direction.

Referring again to FIGS. 2A-2C, the radiating body 111/111*a*/111*b* is arranged in the middle layer 113 or the first layer 112 and spaced from the edge of the substrate 110 by a certain distance. Therefore, even if the substrate 110 comes in contact with the metal frame of the wireless communication device 200, the radiating body 111/111*a*/111*b* is spaced from the metal frame, so that the metal frame does not interfere or shield the radiation of the radiating body 111/111*a*/111*b*.

Referring again to FIG. 1, the second array antenna 50 is arranged on the motherboard 21. The second array antenna 50 is spaced from the first array antennas 10, 30 and is adjacent to the first array antenna 10. The second array antenna 50 is configured to generate radiation along a third direction (a positive Z-axis direction). In one embodiment, the positive Z-axis direction refers to a direction from a display screen (not shown) of the wireless communication device 200 to a back cover (not shown) of the wireless communication device 200.

The second array antenna 50 includes N2 multiply by M2 second antenna units 51. N2 and M2 are positive integers greater than or equal to 1. The N2 second antenna units 51 are arranged at intervals along the first direction. The M2 second antenna units 51 are arranged at intervals along the second direction. In one embodiment, N2 is equal to 2, and M2 is equal to 4. That is, the second array antenna 50 includes 2 by 4 second antenna units 51. In other embodiments, the number of the second antenna units 51 along the first direction and the second direction can be adjusted according to specific requirements.

Figure 3:
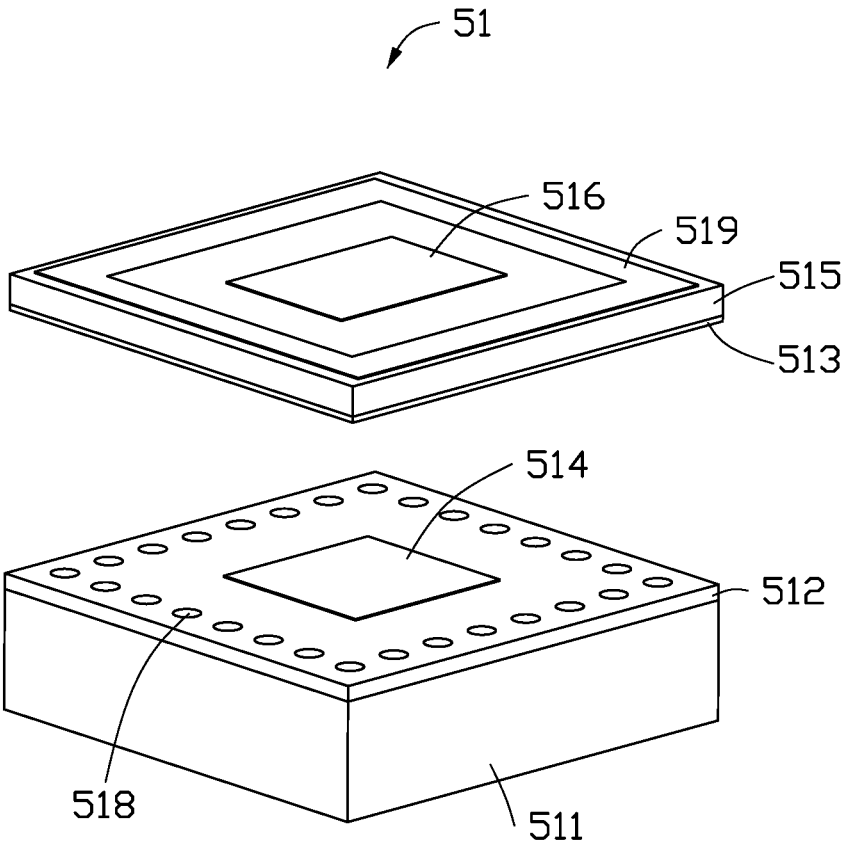
FIG. 3 is a partial exploded perspective view showing a second antenna unit of a second array antenna in FIG. 1.
Figure 4:
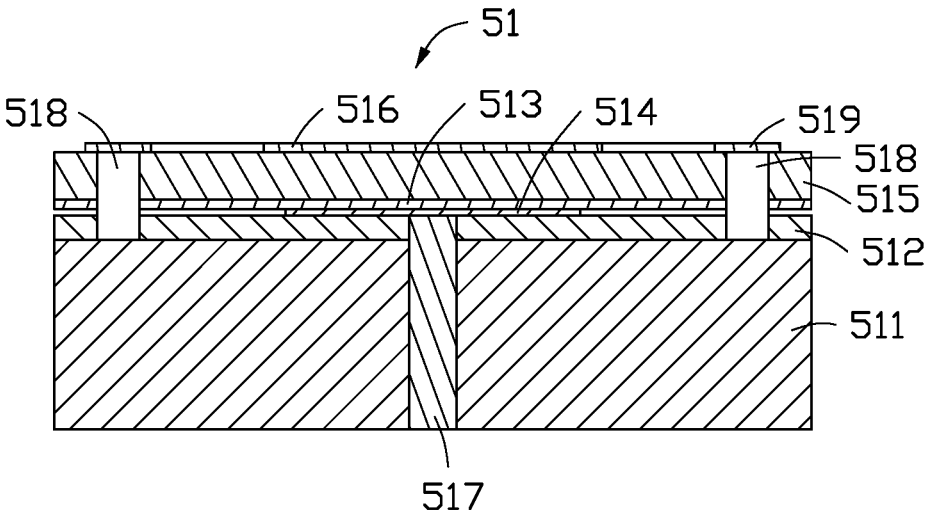
FIG. 4 is a schematic cross-sectional view showing the second antenna unit in the second array antenna in FIG. 3.

As shown in FIG. 3 and FIG. 4, the second antenna units 51 are millimeter wave (mmWave) antennas. Each of the second antenna units 51 includes a ground layer 511, a first substrate 512, an adhesive layer 513, a first radiating portion 514, a second substrate 515, and a second radiating portion 516.

The first substrate 512 is arranged on the ground layer 511. The ground layer 511 is made of metal. A square area of the first radiating portion 514 is less than a square area of the adhesive layer 513. The adhesive layer 513 is a layer of adhesive for bonding the first substrate 512 to the second substrate 515, and the first radiating portion 514 is between the first substrate 512 and the second substrate 515. The first radiating portion 514 is made of metal. The first radiating portion 514 is arranged between the first substrate 512 and the adhesive layer 513 and is electrically coupled to a feed source (not shown) through a feed portion 517 (shown in FIG. 4).

The second substrate 515 is arranged on a surface of the adhesive layer 513 away from the first substrate 512. The first substrate 512 and the second substrate 515 may be made of non-conductive material, such as epoxy glass fiber (FR4) or other dielectric material. The second radiating portion 516 is made of metal. The second radiating portion 516 is arranged on a surface of the second substrate 515 away from the adhesive layer 513.

The second antenna unit 51 further includes a frame portion 519. The frame portion 519 is substantially rectangular frame-shaped and is made of metal. The frame portion 519 is arranged on a surface of the second substrate 515 away from the adhesive layer 513 and surrounds the second radiating portion 516.

The second antenna unit 51 further includes a plurality of second vias 518. The second vias 518 pass through the second substrate 515, the adhesive layer 513, and the first substrate 512 in sequence to electrically couple the frame portion 519 to the ground layer 511.

In one embodiment, the first radiating portion 514 and the second radiating portion 516 are not grounded. When the feed source supplies an electric current, the electric current flows through the first radiating portion 514 and is then coupled to the second radiating portion 516 to cause the first radiating portion 514 and the second radiating portion 516 to excite respective resonant frequencies. The two different resonant frequencies excited by the first radiating portion 514 and the second radiating portion 516 can effectively expand a bandwidth of the second array antenna 50.

In one embodiment, the ground layer 511, the second vias 518, and the frame portion 519 are all made of metal. The ground layer 511, the second vias 518, and the frame portion 519 form a ground of the second antenna unit 51, and the ground layer 511, the second via 518, and the frame portion 519 each provide electromagnetic shielding effect to focus the radiation of the second antenna unit 51 along the third direction.

In one embodiment, the second radiating portion 516 is not coupled to the feed source through a corresponding feed portion. In other embodiments, the second radiating portion 516 can also be coupled to the feed source through a corresponding feed portion. As such, the feed source can directly supply an electric current to the first radiating portion 514 and the second radiating portion 516.

Figure 5:
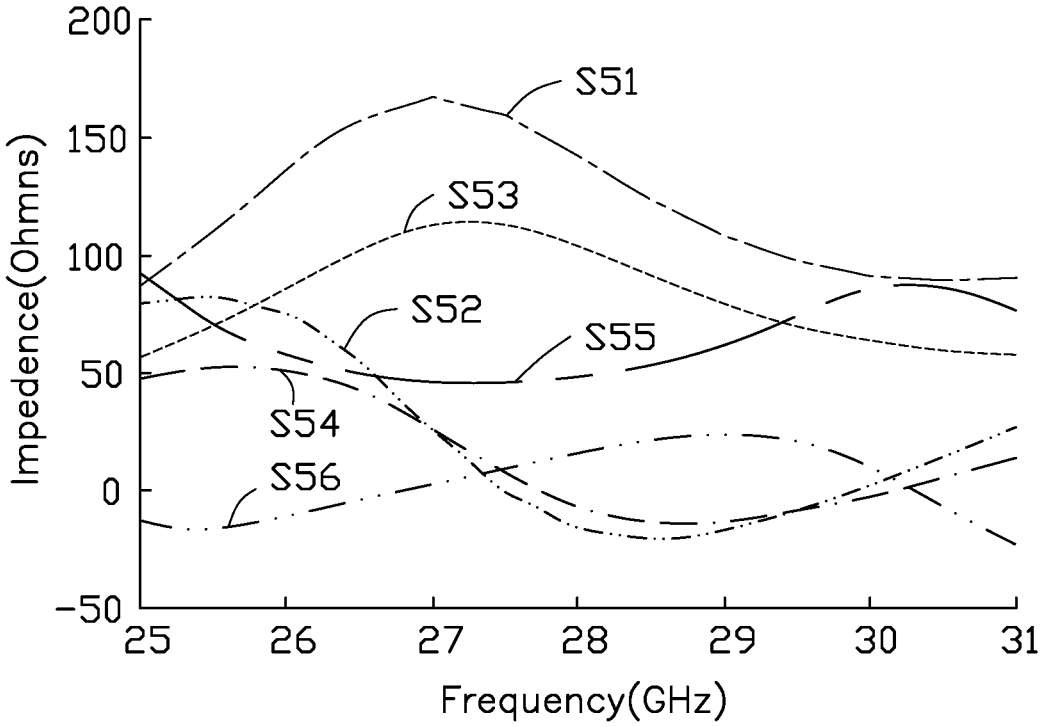
FIG. 5 is a simulation diagram of input impedance of the first antenna unit in the first array antenna in FIG. 1.

FIG. 5 is a schematic diagram of input impedance of the first antenna unit 11/11*a* of the first array antenna 10, 30 in the antenna structure 100. A plotline S51 is a resistance value (R) of a conventional monopole antenna. A plotline S52 is a reactance value (X) of the conventional monopole antenna. A plotline S53 is a resistance value (R) of the first antenna unit 11 of the first array antenna. A plotline S54 is the reactance value (X) of the first antenna unit 11 of the first array antenna. A plotline S55 is a resistance value (R) of the first antenna unit 11*a* of the first array antenna. A plotline S56 is a reactance value (X) of the first antenna unit 11*a* of the first array antenna.

It can be seen from the plotlines S51-S56 that the conventional monopole antenna has a high input impedance (about 158 ohms) at a quarter-wave resonance of the millimeter wave (mmWave), and corresponding wide frequency impedance matching is not easy. The first antenna unit 11/11*a* adopts a monopole antenna having a semicircular shape at one end, which is not only light and thin, but also exhibits lower input impedance and achieves wider frequency impedance matching.

Figure 6:
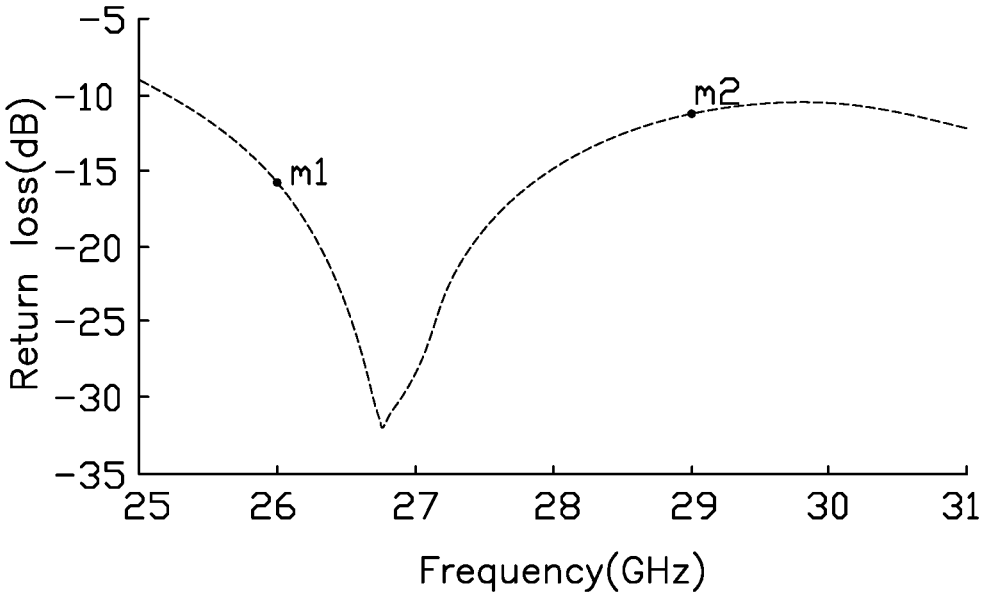
FIG. 6 is a simulation diagram of return loss of the first antenna unit in FIG. 2A.

FIG. 6 is a simulation diagram of return loss of the first antenna unit 11 of the first array antenna. When a frequency point m1 is 26 GHz, a return loss of the first antenna unit 11 is −15.8526 dB. When a frequency point m2 is 29 GHz, a return loss of the first antenna unit 11 is −11.3211 dB.

Figure 7:
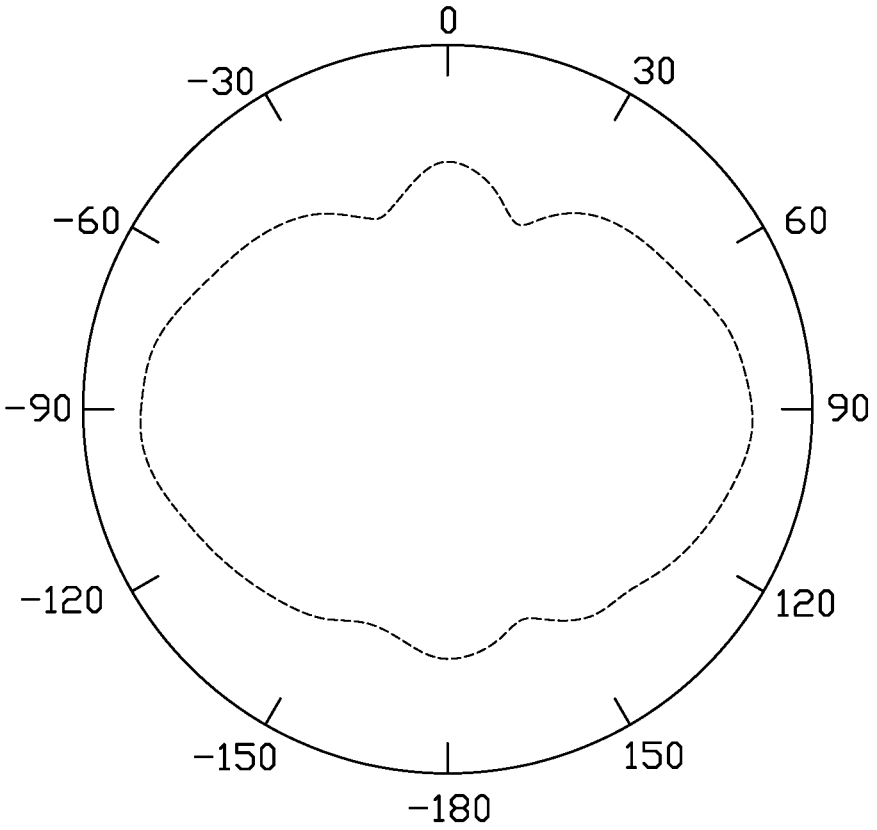
FIG. 7 is a radiation pattern diagram of the first antenna unit in FIG. 2A on an H plane.
Figure 8:
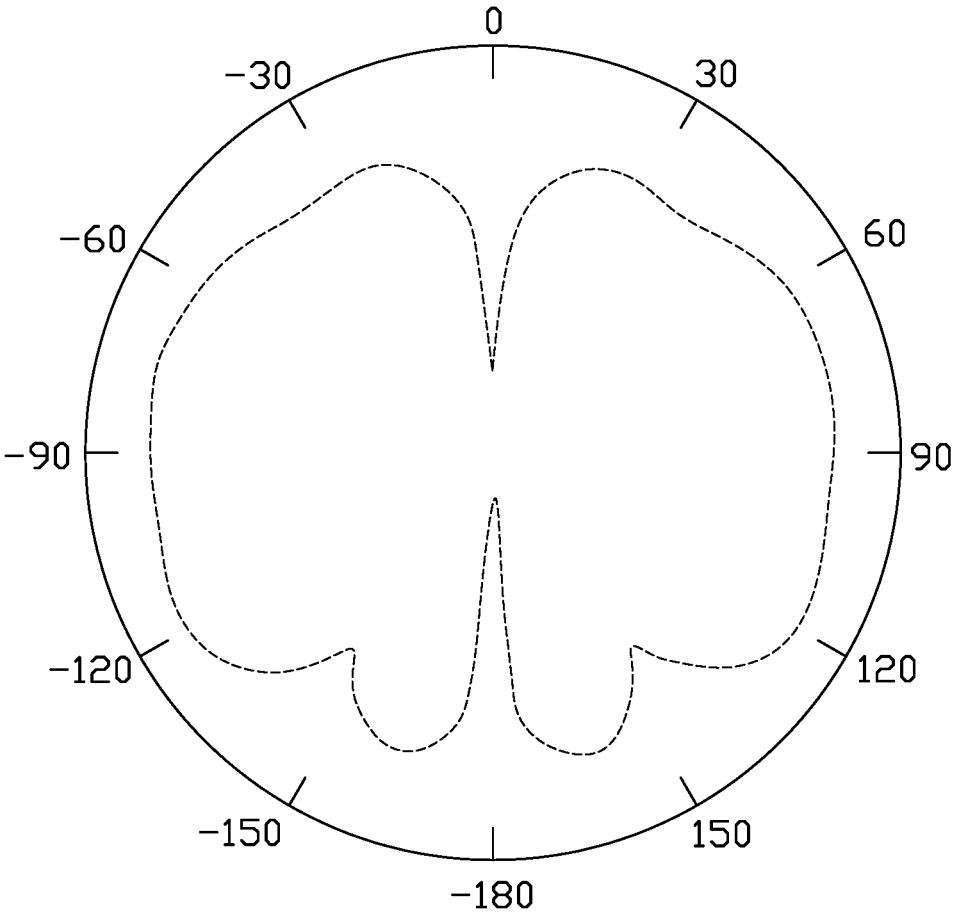
FIG. 8 is a radiation pattern diagram of the first antenna unit in FIG. 2A on the E2 plane.
Figure 9:
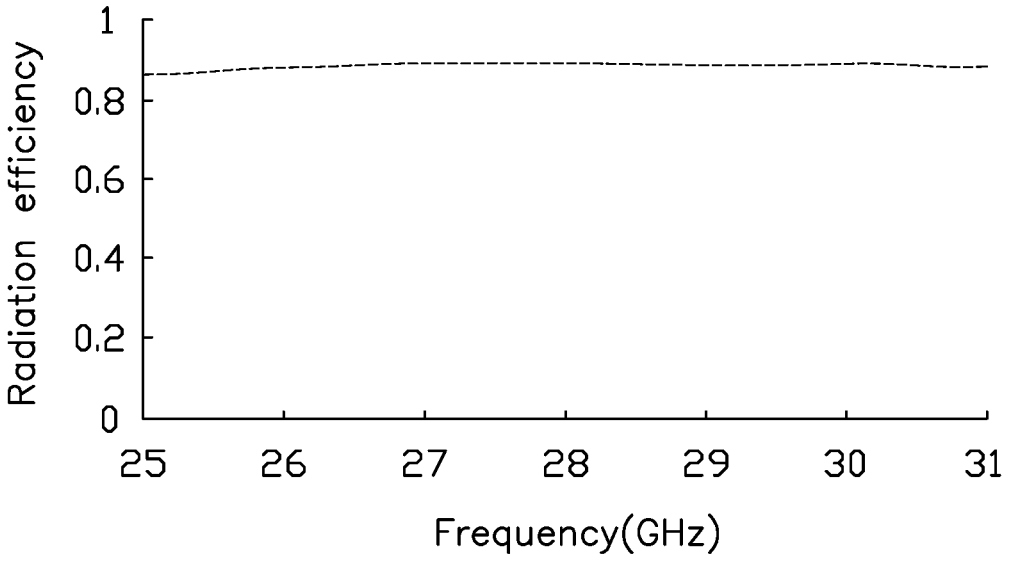
FIG. 9 is a graph showing radiation efficiency of the first antenna unit in FIG. 2A.

FIG. 7 is a radiation pattern diagram of the first antenna unit 11 of the first array antenna on an H plane (the XY plane). FIG. 8 is a radiation pattern diagram of the first antenna unit 11 of the first array antenna on an E2 plane (the XZ plane). FIG. 9 is a graph showing radiation efficiency of the first antenna unit 11 of the first array antenna.

Figure 10:
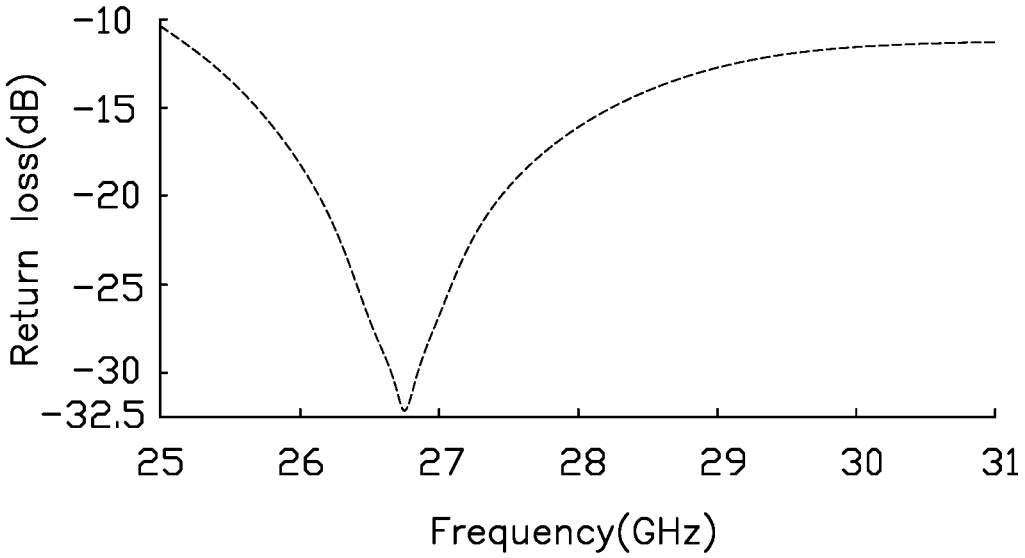
FIG. 10 is a simulation diagram of return loss of the first antenna unit in FIG. 2B.
Figure 11:
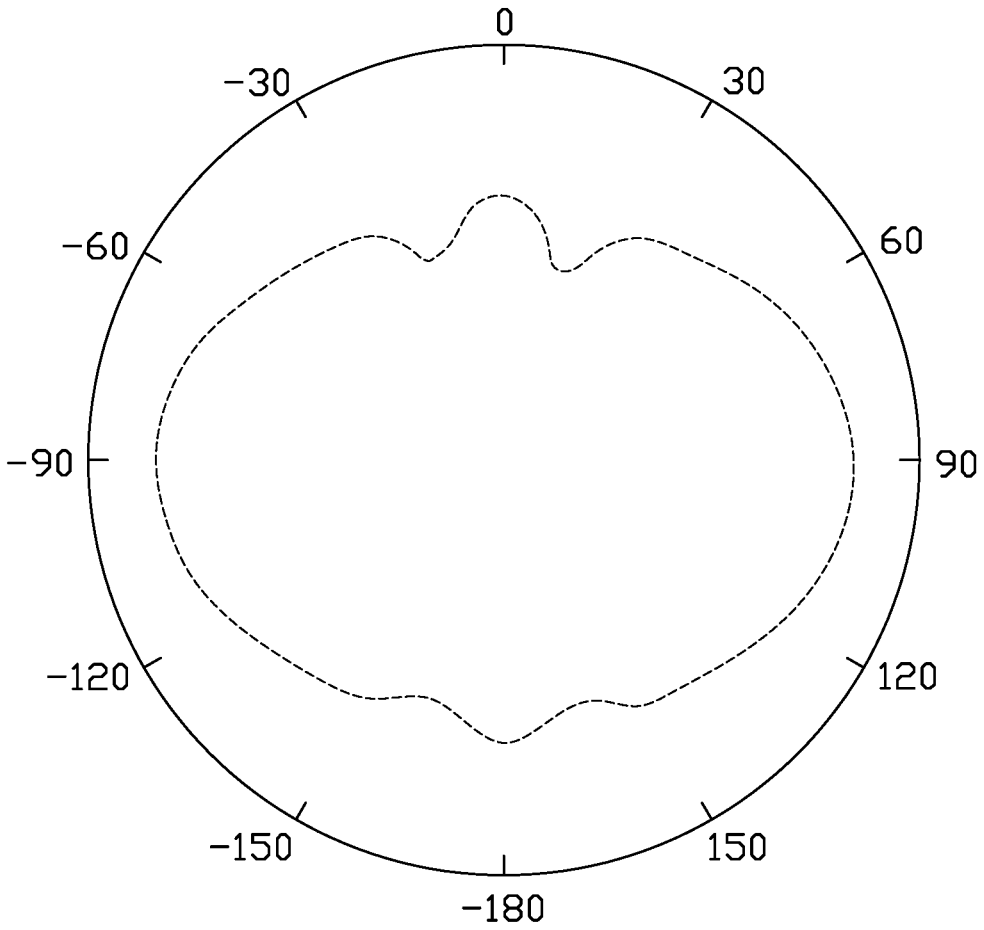
FIG. 11 is a radiation pattern diagram of the first antenna unit in FIG. 2B on the H plane.
Figure 12:
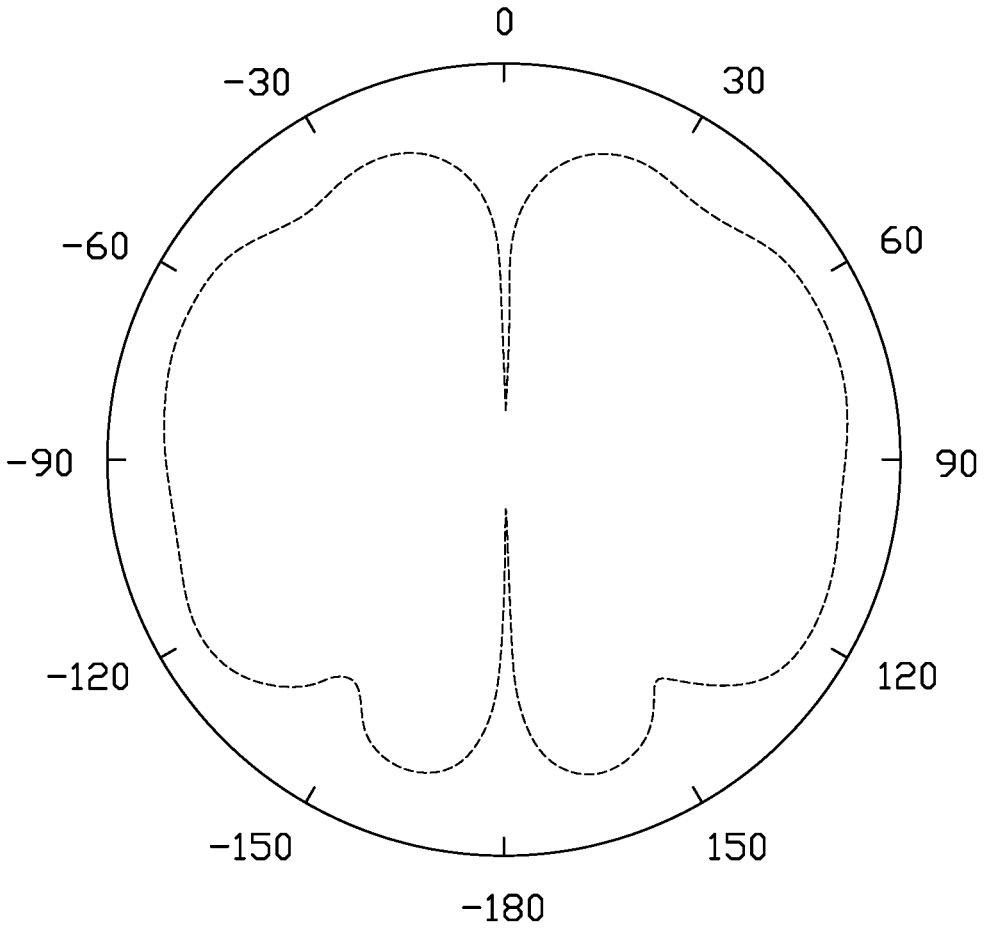
FIG. 12 is a radiation pattern diagram of the first antenna unit in FIG. 2B on the E2 plane.
Figure 13:
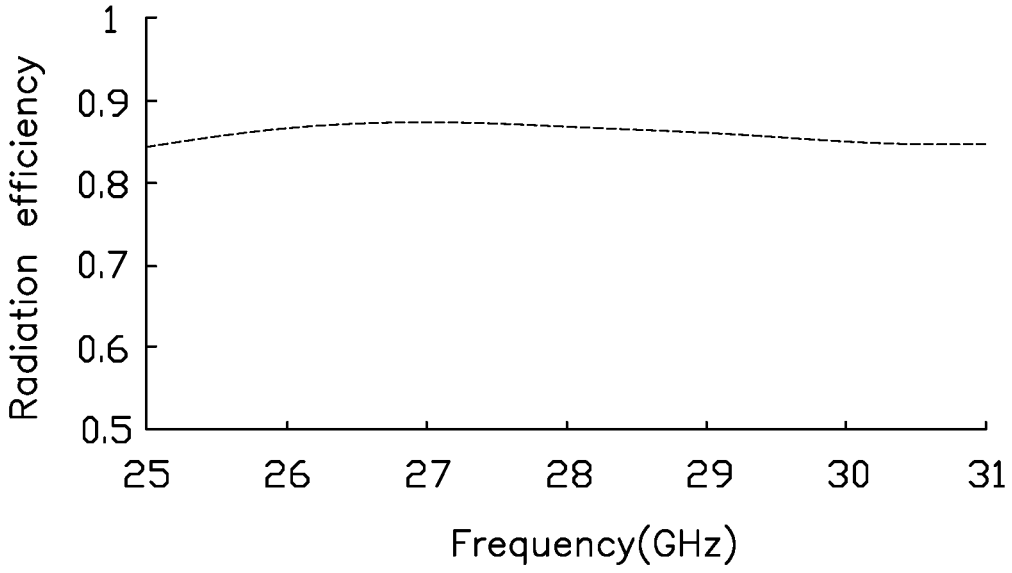
FIG. 13 is a graph showing radiation efficiency of the first antenna unit in FIG. 2B.

FIG. 10 is a simulation diagram of return loss of the first antenna unit 11*a* of the first array antenna. FIG. 11 is a radiation pattern diagram of the first antenna unit 11*a* of the first array antenna on the H plane (the XY plane). FIG. 12 is a radiation pattern diagram of the first antenna unit 11*a* on the E2 plane (the XZ plane). FIG. 13 is a graph showing radiation efficiency of the first antenna unit 11*a* of the first array antenna.

Figure 14:
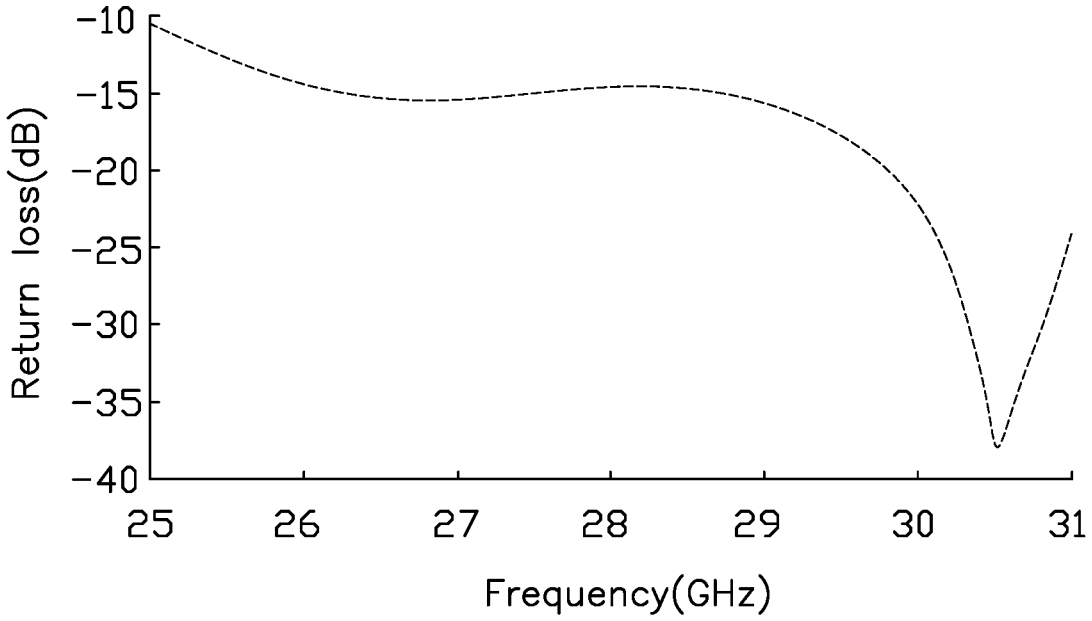
FIG. 14 is a simulation diagram of return loss of the first antenna unit in FIG. 2C.
Figure 15:
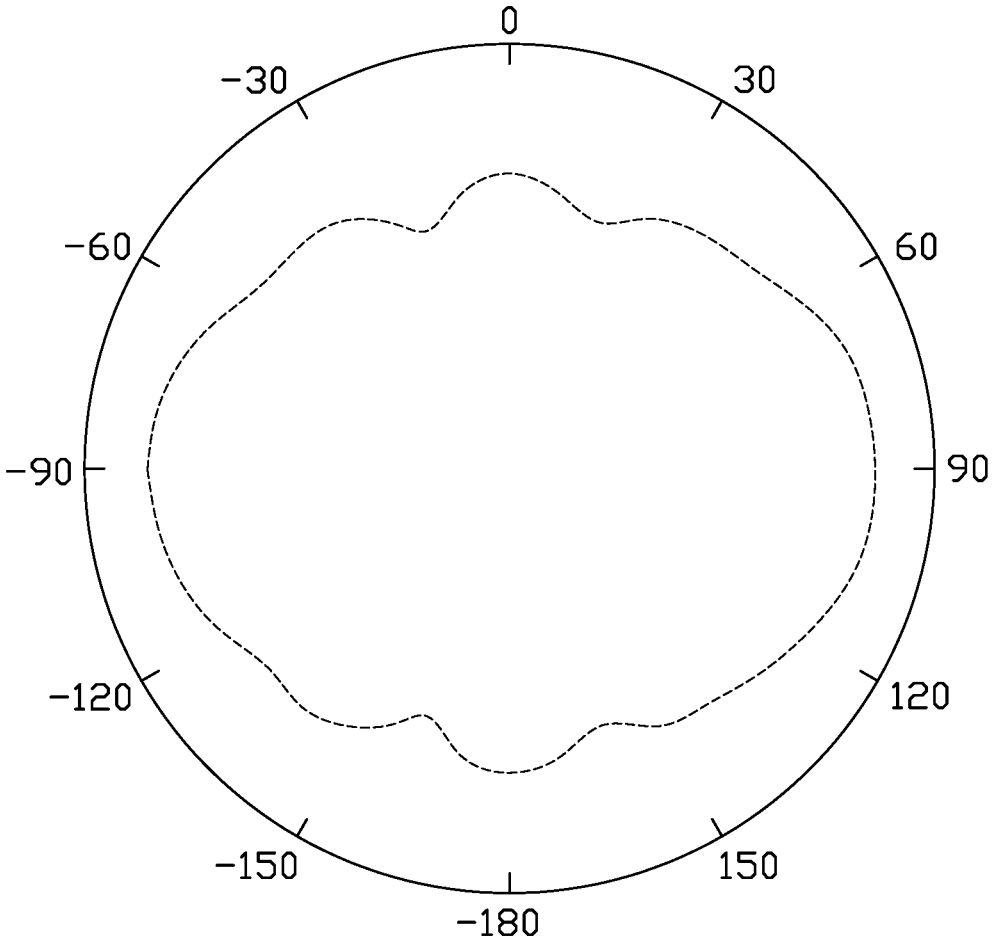
FIG. 15 is a radiation pattern diagram of the first antenna unit in FIG. 2C on the H plane.
Figure 16:
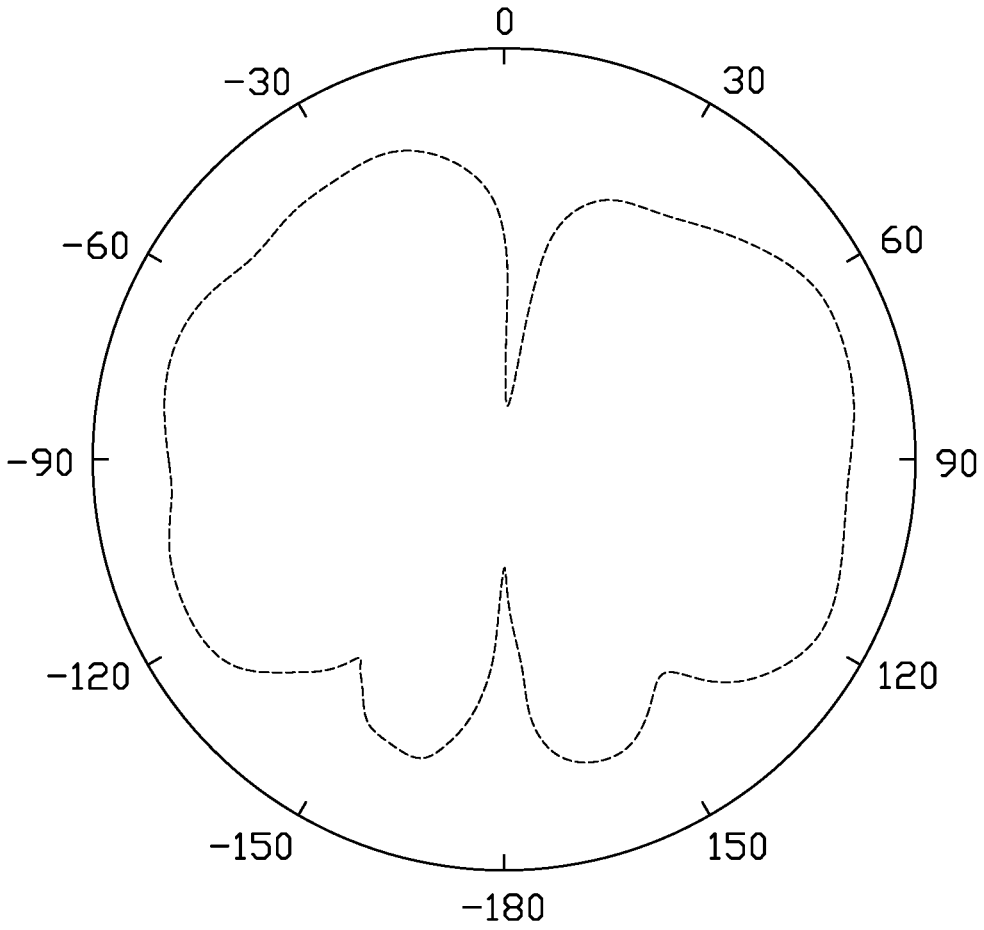
FIG. 16 is a radiation pattern diagram of the first antenna unit in FIG. 2C on the E2 plane.
Figure 17:
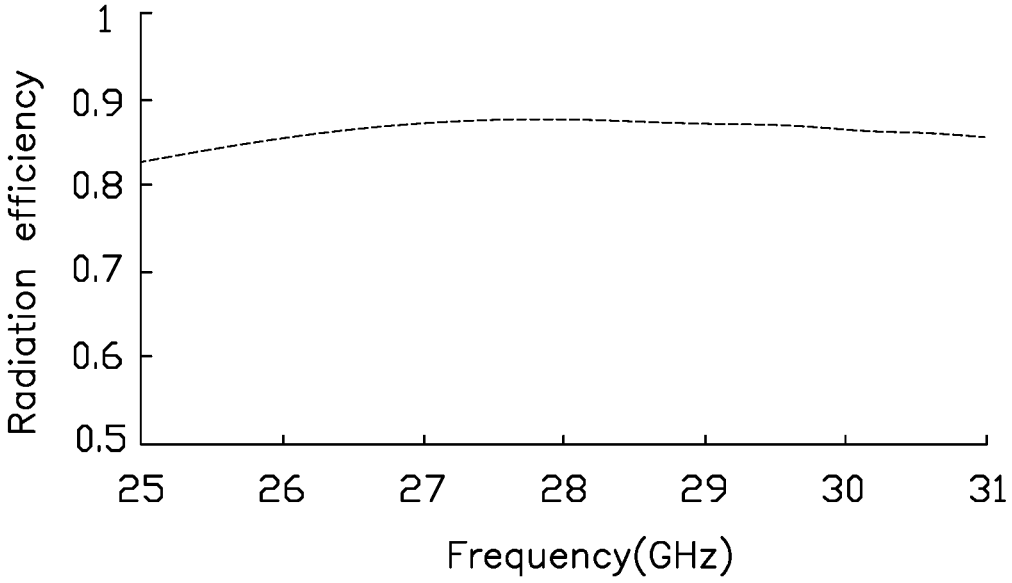
FIG. 17 is a graph showing radiation efficiency of the first antenna unit in FIG. 2C.

FIG. 14 is a simulation diagram of return loss of the first antenna unit 11*b* of the first array antenna. FIG. 15 is a radiation pattern diagram of the first antenna unit 11*b* of the first array antenna on the H plane (the XY plane). FIG. 16 is a radiation pattern diagram of the first antenna unit 11*b* of the first array antenna on the E2 plane (the XZ plane). FIG. 17 is a graph showing radiation efficiency of the first antenna unit 11*b* of the first array antenna.

As can be seen from FIGS. 6-17, the radiation pattern of the first antenna unit 11/11*a*/11*b* of the first array antenna can effectively compensate for a shortage of the second array antenna 50. In other words, the radiation of the second array antenna 50 is mainly focused along the third direction (positive Z-axis direction), so that there is no radiation along the first and second directions. The radiation of the first antenna unit 11/11*a*/11*b* is mainly focused along the first and second directions (X and Y-axis directions), so that the radiation of the antenna structure 100 can cover the X, Y, and Z-axis directions and have an improved range and antenna gain. Moreover, since the first antenna unit 11/11*a*/11*b* is arranged on the side of the motherboard 21, a planar antenna configuration thereof can effectively prevent interference of the radiation by the metal frame of the side.

The present disclosure discloses the antenna structure 100 and the wireless communication device 200 having the antenna structure 100 of an improved radiation coverage of the antenna structure 100 by providing the first array antennas 10, 30 and the second array antenna 50. Interference of the radiation by the metal frame of the wireless communication device 200 is also prevented.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a first array antenna having a plurality of first antenna units, the plurality of first antenna units are arranged along a first direction and a second direction, the plurality of first antenna units are monopole antennas, wherein the monopole antennas comprise:

a radiating body having a strip portion and a bulb portion, the radiating body generates radiation along the first direction or the second direction, wherein the strip portion is electrically coupled to a signal source;

the bulb portion is electrically coupled to the strip portion;

an end of the bulb portion away from the strip portion is semi-circular in shape.

2. The antenna structure of claim 1, wherein:

the plurality of first antenna units further comprises a substrate;

the substrate comprises a first layer having a first ground plane, a middle layer having a second ground plane, and a second layer having a plurality of first vias configured to couple the first ground plane to the second ground plane;

wherein the strip portion is disposed on the middle layer.

3. The antenna structure of claim 2, wherein:

the bulb portion is disposed on the middle layer;

an end of the bulb portion is electrically coupled to the strip portion; and the bulb portion extends along a direction of extension of the strip portion.

4. The antenna structure of claim 2, wherein:

the bulb portion is disposed on the first layer; and an end of the bulb portion is electrically coupled to the strip portion through a corresponding one of the first vias.

5. The antenna structure of claim 2, wherein:

the plurality of first vias partially surrounding the strip portion to provide electromagnetic shielding effect, and radiation directions of the radiating body are focused on two sides of the bulb portion.

6. The antenna structure of claim 1 further comprising two first array antennas, wherein the two first array antennas are respectively located at opposite sides of the antenna structure.

7. The antenna structure of claim 6, wherein a quantity of the first antenna units disposing along the first direction is equal to a quantity of the first antenna units disposing along the second direction.

8. The antenna structure of claim 1 further comprising a second array antenna, wherein:

the second array antenna is spaced from the first array antenna;

the second array antenna having a plurality of second antenna units arranged along the first direction and the second direction is configured to generate radiation along a third direction orthogonal to the first direction and the second direction.

9. The antenna structure of claim 8, wherein:

the plurality of first antenna units and the plurality of second antenna units are millimeter wave antennas.

10. The antenna structure of claim 8, wherein:

the plurality of second antenna units comprises a ground layer, a first substrate, a first radiating portion, a second substrate, and a second radiating portion;

the first substrate is disposed on the ground layer;

the first radiating portion is disposed between the first substrate and the second substrate and is electrically coupled to a feed source through a feed portion;

the second substrate is disposed on a side of the first radiating portion away from the first substrate;

the second radiating portion is disposed on a surface of the second substrate away from the first radiating portion;

when the feed source supplies an electric current, the electric current flows through the first radiating portion and the second radiating portion to cause the first radiating portion and the second radiating portion to generate different resonance frequencies.

11. The antenna structure of claim 10, wherein:

the plurality of second antenna units further comprises a frame portion disposed on a surface of the second substrate away from the first radiating portion and surrounding the second radiating portion;

the plurality of second antenna units further comprises a plurality of second vias passing through the second substrate and the first substrate to electrically couple the frame portion to the ground layer;

the frame portion, the second vias, and the ground layer are made of metal;

the ground layer, the second vias, and the frame portion are adapted to provide electromagnetic shielding effect to focus radiation directions of the plurality of second antenna units along the third direction.

12. A wireless communication device comprising an antenna structure comprising:

a first array antenna having a plurality of first antenna units, the plurality of first antenna units are arranged along a first direction and a second direction, the plurality of first antenna units are monopole antennas, wherein the monopole antennas comprise:

a radiating body having a strip portion and a bulb portion, the radiating body generates radiation along the first direction or the second direction, wherein the strip portion is electrically coupled to a signal source;

the bulb portion is electrically coupled to the strip portion;

an end of the bulb portion away from the strip portion is semi-circular in shape.

13. The wireless communication device of claim 12, wherein:

the plurality of first antenna units further comprises a substrate;

the substrate comprises a first layer having a first ground plane, a middle layer having a second ground plane, and a second layer having a plurality of first vias configured to couple the first ground plane to the second ground plane;

wherein the strip portion is disposed on the middle layer.

14. The wireless communication device of claim 13, wherein:

the bulb portion is disposed on the middle layer;

an end of the bulb portion is electrically coupled to the strip portion; and the bulb portion extends along a direction of extension of the strip portion.

15. The wireless communication device of claim 13, wherein:

the plurality of first vias partially surrounding the strip portion to provide electromagnetic shielding effect, and radiation directions of the radiating body are focused on two sides of the bulb portion.

16. The wireless communication device of claim 12, wherein:

the antenna structure further comprises two first array antennas, wherein the two first array antennas are respectively located at opposite sides of the antenna structure.

17. The wireless communication device of claim 16, wherein a quantity of the first antenna units disposing along the first direction is equal to a quantity of the first antenna units disposing along the second direction.

18. The wireless communication device of claim 12, wherein:

the antenna structure further comprises a second array antenna;

the second array antenna is spaced from the first array antenna;

the second array antenna having a plurality of second antenna units arranged along the first direction and the second direction is configured to generate radiation along a third direction orthogonal to the first direction and the second direction.

19. The wireless communication device of claim 18, wherein:

the plurality of second antenna units comprises a ground layer, a first substrate, a first radiating portion, a second substrate, and a second radiating portion;

the first substrate is disposed on the ground layer;

the first radiating portion is disposed between the first substrate and the second substrate and is electrically coupled to a feed source through a feed portion;

the second substrate is disposed on a side of the first radiating portion away from the first substrate;

the second radiating portion is disposed on a surface of the second substrate away from the first radiating portion;

when the feed source supplies an electric current, the electric current flows through the first radiating portion and the second radiating portion to cause the first radiating portion and the second radiating portion to generate different resonance frequencies.

20. The wireless communication device of claim 19, wherein:

the plurality of second antenna units further comprises a frame portion disposed on a surface of the second substrate away from the first radiating portion and surrounding the second radiating portion;

the plurality of second antenna units further comprises a plurality of second vias passing through the second substrate and the first substrate to electrically couple the frame portion to the ground layer;

the frame portion, the second vias, and the ground layer are made of metal;

the ground layer, the second vias, and the frame portion are adapted to provide electromagnetic shielding effect to focus radiation directions of the plurality of second antenna units along the third direction.

* * * * *